United States Patent [19]

Engström et al.

[11] Patent Number: 4,702,772

[45] Date of Patent: Oct. 27, 1987

[54] SINTERED ALLOY

[75] Inventors: Ulf F. I. Engström; Sven E. Allroth; Olavi M. Mustonen, all of Höganäs, Sweden

[73] Assignee: Hoganas AB, Höganäs, Sweden

[21] Appl. No.: 836,855

[22] Filed: Mar. 6, 1986

[30] Foreign Application Priority Data

Mar. 7, 1985 [SE] Sweden ..... 8501102

[51] Int. Cl.[4] ..... C22C 29/00

[52] U.S. Cl. ..... 75/243; 75/246; 419/11; 419/23

[58] Field of Search ..... 75/243, 246, 128 D, 75/128 W; 419/11, 23

[56] References Cited

U.S. PATENT DOCUMENTS 3,982,905 9/1976 Osawa et al. ..... 75/243

4,360,383 11/1982 Takahashi et al. ..... 75/246

FOREIGN PATENT DOCUMENTS 8400290 5/1984 PCT Int'l Appl. .

334244 4/1971 Sweden .

1162702 8/1969 United Kingdom .

1510455 3/1977 United Kingdom .

2071159 12/1984 United Kingdom .

*Primary Examiner*—Stephen J. Lechert, Jr.

*Attorney, Agent, or Firm*—Merchant, Gould, Smith, Edell, Welter & Schmidt

[57] ABSTRACT

The present invention relates to an iron-base powder containing Ni, Mo and C for producing highly resistant sintered bodies under normal pressing and sintering conditions. The powder contains 7–12% by weight of Ni, 0.4–1.5% by weight of Mo, and 0.3–0.7% by weight of C.

8 Claims, No Drawings

SINTERED ALLOY

BACKGROUND OF THE INVENTION

The present invention relates to an iron-base powder containing nickel and molybdenum, for producing sintered components with high demands on physical properties without the need of increasing the compacting pressure or sintering temperature above what is normal in powder-metallurgical manufacturing techniques.

Characteristic of the powder metallurgical manufacturing technique is the production in long series of components with good dimensional accuracy. The production chain starts by mixing a metallic powder, optionally with the addition of pulverulent alloying materials, with a lubricant to facilitate the subsequent pressing operation. In this operation, the powder is compacted at a pressure generally not exceeding 6 tons/cm$^2$ to a blank whose shape closely or completely conforms to the shape of the finished component. The blank is heated and thereafter maintained at a temperature normally not exceeding 1150° C. at which it is sintered and thus given its final properties, such as strength, toughness, density etc. Materials thus manufactured differ from materials manufactured by melt-metallurgical technique, substantially by their porosity, which may give relatively low density and have an adverse effect on the strength. In order to increase the strength of sintered components of iron powder without the addition of alloying materails, a substantial increase in compacting pressure and/or sintering temperature is necessary, which is costly and difficult to achieve since presses and pressing tools currently used are not intended for higher loads than 6 tons/cm$^2$. Also, the maximum working temperature for the sintering furnaces is most often restricted to 1150° C.

It is also known to use different alloying additives for increasing the strength of sintered steel.

At present, use is made substantially of two types of powder with alloying additives, namely powder mixtures and so-called atomized prealloyed powders. Powders mixtures are prepared by admixing in the iron powder a powder containing the alloying material, either in elementary form or as a compound which is decomposable during the sintering process. The atomized steel powders are manufactured by disintegrating a steel melt containing the desired alloying elements into powder. One of the drawbacks of powder mixtures is the risk of segregation which exists because powders having different characteristics, for example different particle size, are mixed with each other without being mechanically joined. This segregration entails a varying composition of the compacts manufactured from the powder mixture and, as a result, varying dimensional changes during the sintering thereof. Another drawback of powder mixtures is their proneness to produce dust, especially when the alloying material has a very small particle size, which may cause considerable pollution problems.

With the atomized powder, on the other hand, there is no risk of segregation whatever, since each powder particle has the desired composition of the alloy. Nor is the risk of dust formation very great since no elements of small particle size are included. The alloyed atomized powder however suffers from another major drawback, namely its low compressibility depending on the solution-hardening effect the alloying materials have on each powder particle.

A high compressibility is essential when it is desirable to obtain a component having high density, which is a prerequisite for high strength. The compressibility of a powder mixture, on the other hand, is practically the same as that of the iron powder included. This, together with the flexibility as regards the composition of the alloy that is characteristic of powder mixtures, has made powder mixtures the type of alloying powders most commonly used.

Today, the risk of segregation and dust formation can be almost entirely obviated by partial diffusion alloying or by using a binding agent for attaching the alloying elements to the iron particles, the graphite being also suitably bound in this manner without impairing the compressibility (SE patent application No. 8304832-2 (U.S. Ser. No. 732,045), SE Pat. Nos. 8001764-3 (GB Pat. No. 2,071,159) and 334,244).

The choice of alloying element is based on considerations which are well known within the powder-metallurgical field. One example is low contents of nickel and molybdenum and with an addition of copper in order to minimize the dimensional changes.

From SE patent application No. 7703382-7 (GB Pat. No. 1,510,455), it is previously known to produce a high-strength, sintered iron-molybdenum-nickel alloy with an addition of phosphorous. According to this SE application, sintering must however be performed at an elevated temperature (1250° C.) to achieve an ultimate tensile strength of 600 N/mm$^2$.

SUMMARY

The object of the present invention is to produce powder mixtures which after pressing and sintering yield products having considerably improved physical properties combined with high sintered density, without increasing the compacting pressure and/or the sintering temperature above what is normal in powder-metallurgical manufacturing techniques.

In experiments conducted, there were added to an iron powder: nickel in an amount of between 7 and 12% by weight, molybdenum in an amount of between 0.4 and 1.5% by weight, and carbon in the form of graphite in an amount of between 0.3 and 0.7% by weight. All test batches were compacted at 6 tons/cm$^2$ and sintered at 1150° C., whereupon they were tempered according to known technique. Surprisingly, without having to complicate the powder production by using many, or unusual, alloying elements which otherwise seem to be commonly used within the powder metallurgy, there were obtained unexpectedly high strength values, in some cases considerably exceeding 900 N/mm$^2$ and concurrently a density exceeding 7.3 g/cm$^3$.

The powder mixtures according to the invention can be prepared, for example, in the following way:

Alloying materials in elementary form and graphite are admixed with the iron powder.

Nickel and molybdenum can also be partially diffusion-alloyed or attached to the iron particles by means of a binding agent.

In another example, one alloying material is partially diffusion-alloyed to the iron particles and the other is attached by a binding agent. Preferably, nickel metal is bound by a binding agent to the iron particles which in a preceding step have been partially diffusion-alloyed with molbydenum.

One of the alloying materials can also be coated on the surface of the iron particles.

It is always to advantage if the graphite is attached by a binding agent.

The particle size of the iron powder should be less than 350 μm, preferably 175 μm and most preferably 150 μm. The particle size of the alloying materials should be less than 75 μm, preferably less than 44 μm.

DESCRIPTION OF THE PREFERRED EMBODIMENTS

The invention will appear more clearly from the following Examples which are given for illustrative purposes only.

EXAMPLE 1

Six powders A–F were compacted at 6 tons/cm$^2$ and sintered at 1150° C. for 1 h in an atmosphere consisting of 95% by volume of nitrogen gas and 5% by volume of hydrogen gas. After sintering, the sintered bodies were tempered for 1 h at 150° C. Physical properties, such as ultimate tensile strength, elongation at break, hardness and density were determined.

| | | | |
|---|---|---|---|
| Powder A: | 94.5% | by weight | Fe (atomized) |
| | 4.0% | " | Ni |
| | 1.0% | " | Mo |
| | 0.5% | " | C |
| | +0.4% | " | lubricant |
| Powder B: | 92.5% | " | Fe (atomized) |
| | 6.0% | " | Ni |
| | 1.0% | " | Mo |
| | 0.5% | " | C |
| | +0.4% | " | lubricant |
| Powder C: | 88.5% | " | Fe (atomised) |
| | 10.0% | " | Ni |
| | 1.0% | " | Mo |
| | 0.5% | " | C |
| | +0.4% | " | lubricant |
| Powder D: | 83.5% | " | Fe (atomized) |
| | 15.0% | " | Ni |
| | 1.0% | " | Mo |
| | 0.5% | " | C |
| | +0.4% | " | lubricant |
| Powder E: | 93.5% | " | Fe (atomized) |
| | 1.5% | " | Cu |
| | 4.0% | " | Ni |
| | 0.5% | " | Mo |
| | 0.5% | " | C |
| | +0.4% | " | lubricant |
| Powder F:* | 97.25% | " | Fe (atomized) |
| | 1.5% | " | Cr |
| | 0.5% | " | Cu |
| | 0.75% | " | C |
| | +0.4% | " | lubricant |

*Because of the presence of Cr, F is sintered at 1250° C.

The lubricant may be zinc stearate. Powder C is according to the invention. Powders A, B, D–F are comparative examples.

| Mixture | Rm N/mm$^2$ | A % | HV | SD g/cm$^3$ |
|---|---|---|---|---|
| A | 708 | 4.5 | 205 | 7.21 |
| B | 840 | 3.8 | 243 | 7.28 |
| C | 955 | 6.3 | 254 | 7.37 |
| D | 782 | 9.2 | 196 | 7.48 |
| E | 680 | 4.5 | 198 | 7.09 |
| F | 705 | 4.1 | 216 | 7.05 |

Rm here represents ultimate tensile strength, A represents elongation at break, Hv is hardness according to Vicker, and SD is sintered density.

It appears from this Example that mixture C according to the invention gives a very high tensile strength combined with high hardness and density. It must also be considered highly surprising that mixture C has an elongation at break (A) exceeding 6%.

Powders E and F have been used as reference powders to illustrate the normal density according to the above-mentioned known technique.

EXAMPLE 2

Three powders G, H and I, of the following compositions, were prepared. Of these, powders G and H are comparative examples, while powder I is according to the invention.

| | |
|---|---|
| Powder G: | 2.0% Ni |
| | 0.5% Mo |
| | 0.5% C |
| | Balance Fe |
| Powder H: | 2.0% Ni |
| | 0.5% Mo |
| | 0.5% C |
| | Balance Fe |
| Powder I: | 8.0% Ni |
| | 0.5% Mo |
| | 0.5% C |
| | Balance Fe |

After admixture of 0.5% lubricant, the powders were compacted in a tool to test bodies for tensile testing at a compacting pressure of 6 tons/cm$^2$.

The test bodies were thereafter sintered at 1150° C. for 60 min. in an atmosphere consisting of 95% of nitrogen gas and 5% of hydrogen gas.

The bodies made from powder G were subjected to forging directly after sintering, i.e. without previous cooling, whereas the bodies made from powders H and I were cooled according to normal sintering practice.

When measuring the tensile strength and the density on the three different materials, the following results were obtained:

| Material | Tensile strength N/mm$^2$ | Density g/cm$^3$ | Porosity % |
|---|---|---|---|
| G | 784 | 7.80 | 0 |
| H | 480 | 7.10 | |
| I | 900 | 7.30 | |

The above Table shows that sintered steel having very high resistance can be produced according to conventional powder-metallurgical technique. This Example shows that an alloy according to the present invention gives a strength equal to and even higher than that of conventional powder-forged materials. This is so despite the relatively large amount of pores also existing in the sintered alloy. Thus, the alloys according to the present invention make it possible to use microsteel produced according to conventional powder-metallurgical technique, in applications which have not previously been possible.

EXAMPLE 3

A powder J of the composition 8% Ni, 1% Mo, 0.5% C and the balance Fe was prepared. Test bodies were prepared and sintered in the same way as with Powder I above. In measurements, there were obtained a tensile strength of 1150 N/mm$^2$, an elongation at break of 4%, a hardness according to Vicker of 345, and a sintered density of 7.32.

What we claim and desire to secure by Letters Patent is:

1. Iron-base powder containing the elements nickel and molybdenum for producing high-strength sintered bodies, said powder consists essentially of iron, 7–12% by weight of nickel, 0.4–1.5% by weight of molybdenum, and 0.3–0.7% by weight of carbon; said powder further characterized by at most only including other alloying materials merely as naturally occurring impurities.

2. Iron-base powder as claimed in claim 1, characterized in that the powder contains 7.5–10.5% by weight of nickel.

3. Iron-base powder as claimed in claim 1, characterized in that the powder contains 0.5–1.0% by weight of molybdenum.

4. Iron-base powder as claimed in claim 1, characterized in that the powder contains 0.4–0.6% by weight of carbon.

5. Iron-base powder as claimed in claim 1, characterized in that the iron particles included have a size below 350 μm, preferably below 175 μm.

6. Iron-base powder as claimed in claim 1, characterized in that the alloying particles included have a size below 75 μm, preferably below 44 μm.

7. Iron-base powder as claimed in claim 1, characterized in that carbon and nickel metal are attached by a binding agent to the iron particles which are partially diffusion-alloyed with molybdenum.

8. Iron-base powder as claimed in claim 1, characterized in that the powder is admixed with up to 1.5% by weight of lubricant.

* * * * *